US006663477B1

(12) United States Patent
Gee

(10) Patent No.: US 6,663,477 B1
(45) Date of Patent: Dec. 16, 2003

(54) COMPLAINT MEMBRANE FOR RESTRAINING A WORKPIECE AND APPLYING UNIFORM PRESSURE DURING LAPPING TO IMPROVE FLATNESS CONTROL

(75) Inventor: Glenn Gee, San Jose, CA (US)

(73) Assignee: International Business Machines Corporation, Armonk, NY (US)

( * ) Notice: Subject to any disclaimer, the term of this patent is extended or adjusted under 35 U.S.C. 154(b) by 17 days.

(21) Appl. No.: 09/569,074

(22) Filed: May 11, 2000

(51) Int. Cl.[7] ..... B24B 41/06
(52) U.S. Cl. ..... 451/364
(58) Field of Search ..... 451/364, 397, 451/285, 287, 288, 540, 548, 390, 398, 402, 28, 41, 63, 57, 388, 394, 392

(56) References Cited

U.S. PATENT DOCUMENTS

| | | | | |
|---|---|---|---|---|
| 4,918,869 A | | 4/1990 | Kitta | |
| 5,203,119 A | | 4/1993 | Cole | |
| 5,205,082 A | | 4/1993 | Shendon et al. | |
| 5,468,177 A | | 11/1995 | Kindler et al. | |
| 5,525,091 A | | 6/1996 | Lam et al. | |
| 5,584,751 A | | 12/1996 | Kobayashi et al. | |
| 5,607,340 A | | 3/1997 | Lackey et al. | |
| 5,635,083 A | * | 6/1997 | Breivogel et al. | 451/289 |
| 5,762,544 A | | 6/1998 | Zuniga et al. | |
| 5,913,719 A | * | 6/1999 | Hasegawa et al. | 451/364 |
| 5,951,371 A | | 9/1999 | Hao | |
| 6,120,360 A | * | 9/2000 | Ball et al. | 451/388 |
| 6,123,608 A | * | 9/2000 | Nakagawa et al. | 451/28 |
| 6,163,954 A | * | 12/2000 | Nakagawa | 451/57 |
| 6,225,224 B1 | * | 5/2001 | Pandey et al. | 438/692 |

FOREIGN PATENT DOCUMENTS

| | | |
|---|---|---|
| JP | 403263604 A | 3/1990 |
| JP | 8129716 A | 5/1996 |

* cited by examiner

*Primary Examiner*—Joseph J. Hail, III
*Assistant Examiner*—Hadi Shakeri
(74) *Attorney, Agent, or Firm*—Robert B. Martin; Bracewell & Patterson, L.L.P.

(57) ABSTRACT

A lapping process fixture has a base with a mounting surface and a membrane on the mounting surface for supporting a workpiece. The membrane is bonded to the mounting surface and has adhesive on its outer surface such that the workpiece adheres to it. The membrane extends across and seals an opening to a cavity inside the base. The cavity is filled with fluid that may be sealed or externally pressurized through ports in the base. The fixture restrains the workpiece to minimize distortion of its surface during processing. The workpiece is restrained from normal-directed movement by fluidic pressure such that the normal force is uniformly distributed across the surface area of the workpiece. The external adhesive on the membrane restrains the workpiece from tangential movement.

12 Claims, 3 Drawing Sheets

COMPLAINT MEMBRANE FOR RESTRAINING A WORKPIECE AND APPLYING UNIFORM PRESSURE DURING LAPPING TO IMPROVE FLATNESS CONTROL

BACKGROUND OF THE INVENTION

1. Technical Field

The present invention relates in general to an improved fixture for restraining workpieces, and in particular to improving the flatness control of a workpiece during a lapping process. Still more particularly, the present invention relates to a compliant membrane for restraining a workpiece and applying uniform pressure thereto during a lapping process to improve flatness control thereof.

2. Description of the Prior Art

Data access and storage devices (DASDs) such as disk drives use magnetic recording heads to read data from or write data to the disks as they spin inside the drive. Each head has a polished air bearing surface (ABS) with flatness parameters, such as crown, camber, and twist. The ABS allows the head to "fly" above the surface of its respective spinning disk. In order to achieve the desired fly height, fly height variance, take-off speed, and other aerodynamic characteristics, the flatness parameters of the ABS need to be tightly controlled.

Although a number of processing steps are required to manufacture heads, the ABS flatness parameters are primarily determined during the final lapping process. The final lapping process may be performed on the heads after they have been separated or segmented into individual pieces, or on rows of heads prior to the segmentation step. This process requires the head or row to be restrained while an abrasive plate of specified curvature is rubbed against it. As the plate abrades the surface of the head, the abrasion process causes material removal on the head ABS and, in the optimum case, will cause the ABS to conform to the contour or curvature of the plate. The final lapping process also creates and defines the proper magnetic read sensor and write element material heights needed for magnetic recording.

There are a number of factors that affect the accuracy of ABS curvature during the final lapping process. These include diamond size/morphology, lubricant chemistry, lapping tangential surface velocity, plate material, lapping motion/path on the plate, and other lapping parameters. In addition to these parameters, three critical conditions must be satisfied. First, it is essential that the contour of the abrasive plate be tightly controlled since, in the best case, the ABS will conform to the curvature of the plate. In addition, all components of the process, including the head/row, must be restrained without distortion during lapping. Any variance in the restraining forces will cause the parts to distort and/or elastically deform upon removal of the forces. For example, if a head or row is lapped on an absolutely flat surface while it is clamped in a fixture, the part will elastically deform to a non-flat condition when it is released. The amount of deformation is proportional to the amount of elastic distortion created when the part was initially clamped.

A third condition affecting the accuracy of the ABS is the lapping force, which is the amount of force exerted by the abrasive plate on the part being lapped. Ideally, the lapping force is minimized to reduce distortion during the lapping process. The holding fixture exerts forces which are normal to the plate for pushing the part against the plate, and tangential to the plate for causing the part to slide over the plate for material removal. Unfortunately, this combination of forces elastically distorts the part (e.g., the head).

For example, to lap a flat surface on an initially curved ABS, the normal-directed force of the flat (and assumably non-deformable) plate against the curved ABS causes the ABS to temporarily flatten. The amount of deflection or flattening of the part will depend on the magnitude, direction, and distribution of the force on the part. Under sufficiently high normal-directed force, the entire surface area of the ABS is in contact with the plate. Introducing tangential movement of the part against an abrasive flat plate causes the entire surface area of the ABS to be abraded, not just the non-flat portions of the ABS. Upon removal of the normal-directed force, the ABS will elastically return to a non-flat condition. To minimize the amount of elastic return, it is desirable to provide a low but evenly distributed, normal-directed force on the part. The desired optimum low normal force will depend on a number of factors, such as diamond size/morphology, lubricant chemistry, lapping tangential velocity, and other lapping parameters. Thus, an improved apparatus and method for accurately defining the curvature of an ABS during the final lapping process is needed.

SUMMARY OF THE INVENTION

A lapping process fixture has a base with a mounting surface and a membrane on the mounting surface for supporting a workpiece. The membrane is bonded to the mounting surface and has adhesive on its outer surface such that the workpiece adheres to it. The membrane extends across and seals an opening to a cavity inside the base. The cavity is filled with fluid that may be sealed or externally pressurized through ports in the base. The fixture restrains the workpiece to minimize distortion of its surface during processing. The workpiece is restrained from normal-directed movement by fluidic pressure such that the normal force is uniformly distributed across the surface area of the workpiece. The external adhesive on the membrane restrains the workpiece from tangential movement.

Accordingly, it is an object of the present invention to provide an improved fixture for restraining workpieces.

It is an additional object of the present invention to improve the flatness control of a workpiece during a lapping process.

Still another object of the present invention is to provide a compliant membrane for restraining a workpiece and applying uniform pressure thereto during a lapping process to improve flatness control thereof.

The foregoing and other objects and advantages of the present invention will be apparent to those skilled in the art, in view of the following detailed description of the preferred embodiment of the present invention, taken in conjunction with the appended claims and the accompanying drawings.

DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

Figure 1:
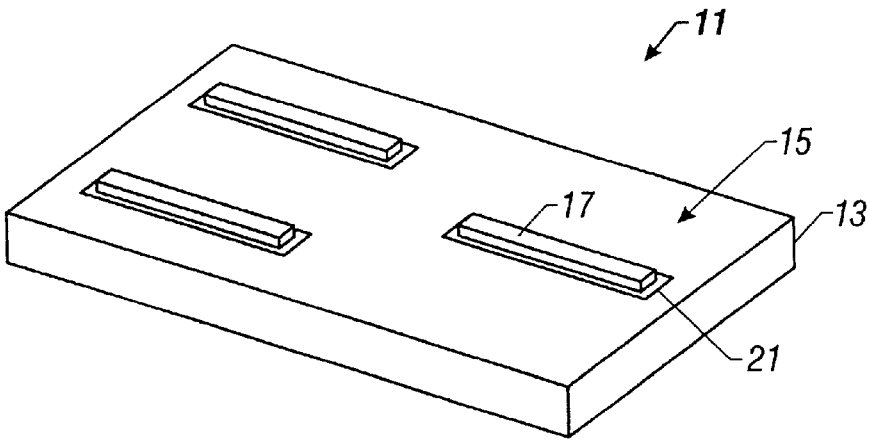
FIG. 1 is an isometric view of a first embodiment of a fixture constructed in accordance with the invention and shown supporting a plurality of workpieces.
Figure 2:
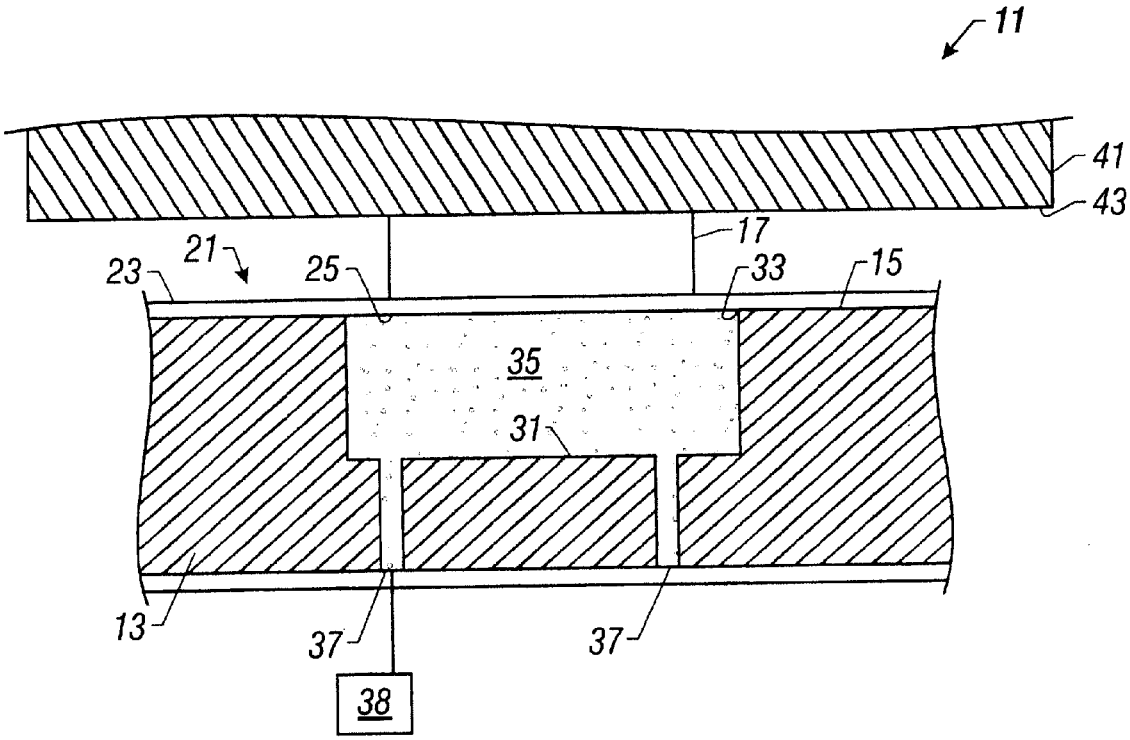
FIG. 2 is a sectional end view of the fixture of FIG. 1 shown lapping one of the workpieces.

Referring to FIGS. 1 and 2, a first embodiment of the invention is shown as a lapping process fixture 11. Fixture 11 comprises a generally rectangular base 13 having a mounting surface 15 for supporting a plurality of discrete workpieces 17. Although fixture 11 is shown supporting three rows 17 of magnetic read/write head stock, each having a plurality of air bearing surfaces (ABS) thereon, more or fewer rows may be supported by fixture 11, as well as other types and sizes of workpieces. In addition, fixture 11 may be adapted for use with different types of processing techniques other than lapping.

Each workpiece 17 is located on a thin flexible sheet or membrane 21 that is slightly larger in surface area than the workpiece 17 it supports. Membranes 21 are substantially planar and parallel to mounting surface 15. As shown in FIG. 2, each membrane 21 has an outer surface 23 and an inner surface 25. In the preferred embodiment, outer and inner surfaces 23, 25 are each coated with adhesive, such that workpiece 17 adheres to the outer surface 23, and the inner surface 25 bonds to a portion of the mounting surface 15 of base 13 of fixture 11. Membranes 21 may utilize other forms of attachment as well, but typically comprise double-sided strips of conventional adhesive dicing tape. Each membrane 21 spans or extends across a generally rectangular, internal cavity 31 inside base 13. Each cavity 31 has a opening 33 in mounting surface 15 that is sealed by its respective membrane 21. Workpiece 17 is located within the surface area defined by opening 33.

A fluid 35 such as a gas or liquid is located inside each of the cavities 31. In the preferred embodiment, fluid 35 comprises pressurized air or water. Fluid 35 provides membrane 21 with a resilient outer surface 23 for supporting workpiece 17. The cavities 31 may be filled with fluid 35 through one or more ports 37. In one version, ports 37 are sealed after fluid 35 is pressurized. In another version, fluid 35 is pressurized via an external pressure source, such as a pump 38, which delivers fluid 35 through at least one port 37. When liquid is used as fluid 35, the second port 37 may be used to purge air during the filling process.

In operation, fixture 11 is provided as a means of holding the rows 17 such that distortion of their ABS due to restraining or holding forces is minimized. Each membrane 21 supports one row 17 while it is processed with a lapping device 41 having a lapping surface 43. Since the row 17 is located completely within the area defined by opening 33 in base 15, the row 17 is fully supported by membrane 21 and is substantially restrained from movement in a direction normal to membrane 21 and mounting surface 15 by the pressure of fluid 35. The thin membrane 21 bends elastically very easily due to its low bending moment of inertia. Because membrane 21 has very low stiffness to bending, distortion of workpiece 17 in the normal direction is low. Moreover, since the normal-directed support is provided by fluid pressure, the force is uniformly distributed across the attached surface of workpiece 17.

In addition, the adhesive coating on outer surface 23 of membrane 21 substantially restrains workpiece 17 from movement in a direction that is tangential to membrane 21. The adhesive on membrane 21 provides the tangential force needed to drag the ABS along the lap plate 41. This allows workpiece 17 to be lapped against lap plate 41 such that its ABS will conform to the shape of lapping surface 43. Membrane 21 provides excellent transfer of tangential force because the tangential force is in the tension axis of the material of membrane 21.

Figure 3:
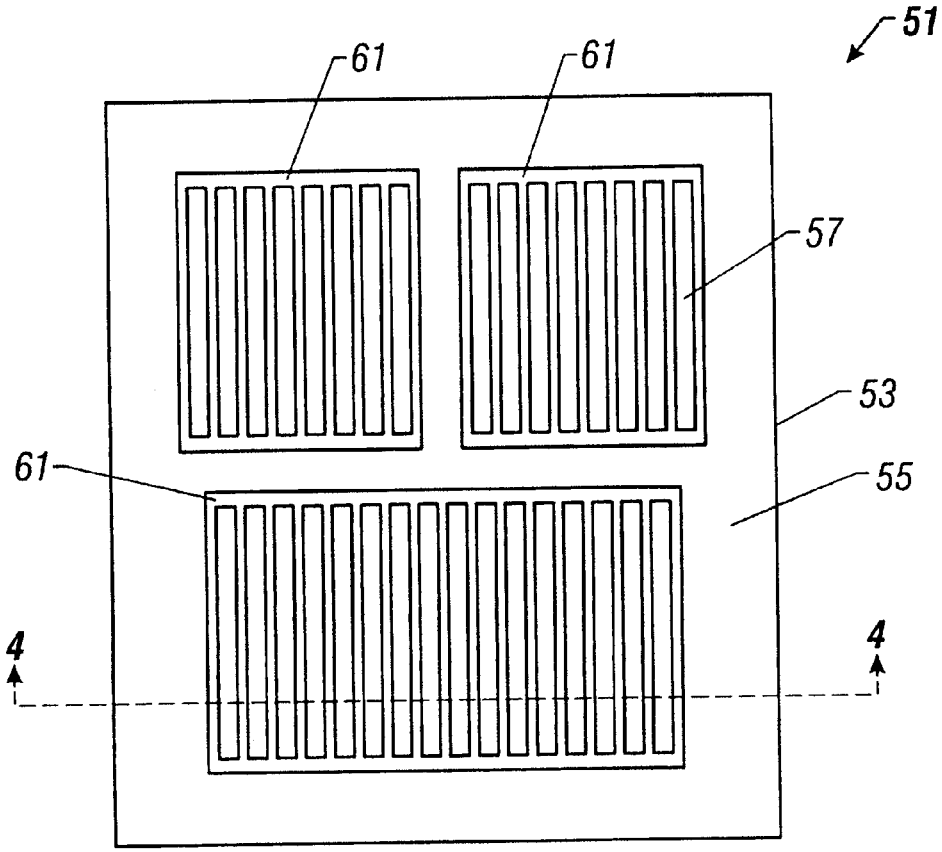
FIG. 3 is a top plan view of a second embodiment of the fixture of FIG. 1.
Figure 4:
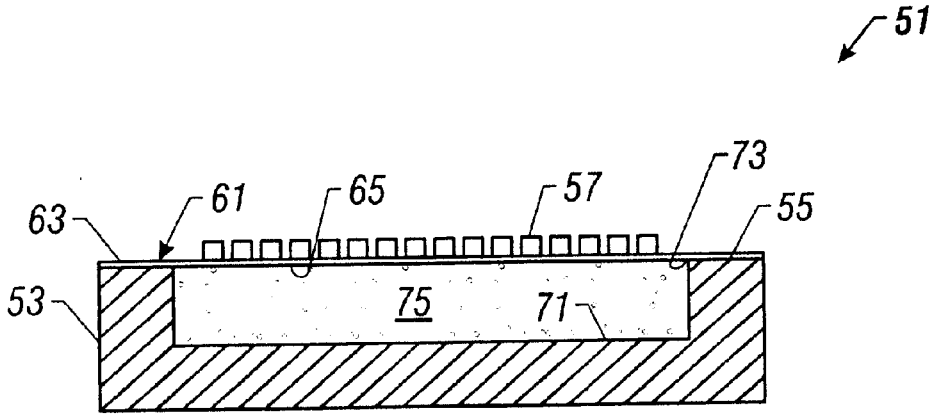
FIG. 4 is a sectional side view of the fixture of FIG. 3 taken along the line 4—4 of FIG. 3.

Referring now to FIGS. 3 and 4, a second embodiment of the invention is shown as lapping process fixture 51. Fixture 51 is very similar to fixture 11 and has a base 53 with a mounting surface 55. However, fixture 51 has much larger membranes 61 for supporting larger arrays of workpieces 57 such as slider rows with ABS. As before, each membrane 61 is slightly larger in surface area than the workpiece 57 it supports and has an outer surface 63 and an inner surface 65. In the preferred embodiment, outer and inner surfaces 63, 65 are each coated with adhesive, such that workpiece 57 adheres to the outer surface 63, and the inner surface 65 bonds to a portion of the mounting surface 55 of base 53. Each membrane 61 extends across and seals an opening 73 in a cavity 71 inside base 53. As described for the first embodiment, cavities 71 are filled with a fluid 75 that may or may not be sealed or externally pressurized through ports in base 53.

In operation, fixture 51 restrains rows 57 to minimize distortion of their ABS during lapping. The rows 57 are substantially restrained from movement in the normal direction by the fluidic pressure such that the normal force is uniformly distributed across the attached surface of rows 57. The adhesive coating on membrane 61 substantially restrains rows 57 from tangential movement in order to drag the ABS along the lap plate. Rows 57 are lapped against the lap plate such that their ABS conform to the shape of lapping surface.

Figure 5:
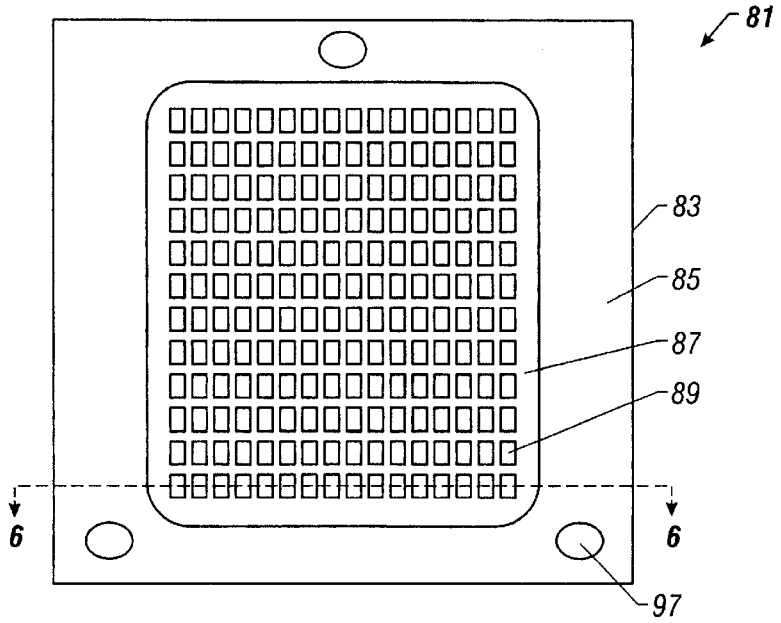
FIG. 5 is a top plan view of a third embodiment of the fixture of FIG. 1.
Figure 6:
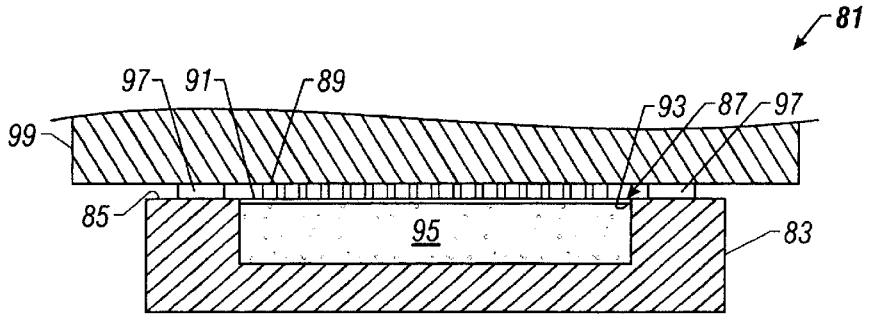
FIG. 6 is a sectional side view of the fixture of FIG. 5 taken along the line 6—6 of FIG. 5.

Referring now to FIGS. 5 and 6, a third embodiment of the invention is shown as lapping process fixture 81. Fixture 81 is a simplified version of the previous fixtures including a base 83 with a mounting surface 85, but fixture 81 only has one membrane 87 for supporting an array of discrete sliders or heads 89 with ABS. Membrane 87 is bonded to mounting surface 85 and has adhesive on its outer surface 91 such that heads 89 adhere to it. Membrane 87 extends across and seals an opening 93 in a cavity 95 inside base 83. Cavity 95 is filled with fluid that may or may not be sealed or externally pressurized through ports in base 83. Fixture 81 restrains heads 89 to minimize distortion of their ABS during lapping. The heads 89 are restrained from normal-directed movement by fluidic pressure such that the normal force is uniformly distributed across the surface area of each head 89. The external adhesive on membrane 87 restrains heads 89 from tangential movement to drag the ABS along the lap plate. Heads 89 are lapped against the lap plate such that their ABS conform to the shape of lapping surface.

Fixture 81 is also provided with a plurality of wear pads 97 which assist in providing a fixed spacing between the lapping plate 99 and fixture 81. During the lapping procedure, fixture 81 rests against plate 99 via wear pads 97. Thus, both the ABS of heads 89 and wear pads 97 are abraded simultaneously. The fixed spacing provided by wear pads 97 will slowly decrease with wear.

The invention has several advantages including the ability to restrain a workpiece in such a manner that minimizes the restraining forces exerted on the workpiece, thereby minimizing distortion of the workpiece during lapping processes. The highly compliant fixture allows the ABS to be more uniformly, quickly, and accurately lapped to conform to the shape of the lapping surface. Assuming negligible force is need to deflect the membrane in the normal direction of the supporting membrane, the fluid will cause the membrane to conform to the curvature of the head/row at the adhesive attachment region and, hence, minimize distortion of the workpiece. This will allow tighter control of curvature in ABS for the lapping process.

While the invention has been shown or described in only some of its forms, it should be apparent to those skilled in the art that it is not so limited, but is susceptible to various changes without departing from the scope of the invention.

What is claimed is:

1. A fixture for restraining a workpiece, comprising:

a base having a surface and an internal cavity with an opening in the surface;

a flexible membrane extending across the cavity adjacent to the opening;

a fluid located behind the membrane for providing the membrane with a resilient outer surface; wherein the membrane is adapted to support a workpiece that is located within an area defined by the opening in the base such that the fluid substantially restrains the workpiece from movement in a direction normal to the membrane via fluid pressure; and wherein the fixture further comprises:

an adhesive on the resilient outer surface of the membrane for substantially restraining the workpiece from movement in a direction tangential to the membrane strictly via adhesive bonding with a tangential force in a tension axis of the membrane.

2. The fixture of claim 1 wherein the membrane extends across the opening in the base and is secured to the surface of the base.

3. The fixture of claim 1 wherein the membrane comprises double-sided dicing tape.

4. The fixture of claim 1 wherein the membrane seals the fluid in the cavity.

5. The fixture of claim 1 wherein the fluid is externally pressurized with a pump and fills the cavity.

6. The fixture of claim 1 wherein the base has a port extending from the cavity to an exterior of the base.

7. The fixture of claim 6 wherein the port is sealed.

8. The fixture of claim 6 wherein the fluid is adapted to be pressurized through the port.

9. The fixture of claim 1, further comprising a plurality of discrete wear pads spaced apart from each other and the workpiece, and mounted to the surface of the base and adapted to support a processing tool during processing of the workpiece.

10. A fixture for restraining a workpiece relative to a lapping surface, comprising:

a base having a mounting surface, an internal cavity with an opening in the mounting surface, and a port extending from the internal cavity to an exterior of the base;

a flexible membrane having an outer surface, and an inner surface secured to the mounting surface of the base with an adhesive and extending across the internal cavity to seal the opening;

an adhesive coating on the outer surface of the membrane;

a fluid located in and substantially filling the cavity in the base to provide the membrane with a resilient outer surface;

a pump for externally pressurizing the fluid through the port in the base; and wherein the membrane is adapted to support a workpiece during a lapping process that is located within an area defined by the opening such that the fluid substantially restrains the workpiece from movement in a direction normal to the membrane, and the adhesive coating substantially restrains the workpiece from movement in a direction tangential to the membrane strictly via adhesive bonding with a tangential force in a tension axis of the membrane.

11. The fixture of claim 10, further comprising a plurality of discrete wear pads spaced apart from each other and the workpiece, and secured to the mounting surface of the base and adapted to provide a fixed spacing between the lapping surface and the base during the lapping process.

12. A fixture for restraining a workpiece relative to a lapping surface, comprising:

a base having a mounting surface, an internal cavity with an opening in the mounting surface, and a port extending from the internal cavity to an exterior of the base;

a flexible membrane having an outer surface, and an inner surface bonded to the mounting surface of the base and extending across the internal cavity to seal the opening;

an adhesive coating on the outer surface of the membrane;

a fluid located in the cavity of the base and adapted to be pressurized through the port to provide the membrane with a resilient outer surface;

a plurality of wear pads spaced apart from each other and the workpiece, and secured to the mounting surface of the base and adapted to provide a fixed spacing between the lapping surface and the base during the lapping process; and wherein the membrane is adapted to support a workpiece during a lapping process that is located within an area defined by the opening such that the fluid substantially restrains the workpiece from movement in a direction normal to the membrane, and the adhesive coating substantially restrains the workpiece from movement in a direction tangential to the membrane strictly via adhesive bonding with a tangential force in a tension axis of the membrane.

* * * * *